United States Patent [19]

Meyer

[11] 3,977,386

[45] Aug. 31, 1976

[54] FOOTBALL LAUNCHING APPARATUS

[75] Inventor: Burton C. Meyer, Downers Grove, Ill.

[73] Assignee: Marvin Glass & Associates, Chicago, Ill.

[22] Filed: Jan. 14, 1974

[21] Appl. No.: 433,211

[52] U.S. Cl. ..... 124/7; 124/36; 124/40; 124/41 R; 273/55 R

[51] Int. Cl.[2] ..... A63B 67/00; F41B 3/02

[58] Field of Search ..... 273/55 R, 26 D, 29 A, 273/129; 124/1, 6, 36, 16, 41, 30 R

[56] References Cited

UNITED STATES PATENTS

| | | | |
|---|---|---|---|
| 2,522,160 | 9/1950 | Borchers | 273/129 |
| 2,767,985 | 10/1956 | Maxcey, Jr. et al. | 273/55 R |
| 2,926,170 | 12/1975 | Dixon | 273/55 R X |
| 3,261,340 | 7/1966 | Laird | 124/36 X |
| 3,399,892 | 9/1968 | Jurkiewicz | 273/55 R |
| 3,777,733 | 12/1973 | Mitchell | 124/36 |
| 3,951,125 | 4/1976 | Dixon | 273/55 R X |

*Primary Examiner*—Richard C. Pinkham
*Assistant Examiner*—T. Brown
*Attorney, Agent, or Firm*—Coffee & Sweeney

[57] ABSTRACT

A launching device for propelling a football into an airborne trajectory with the football pointed forwardly and rotating about its longitudinal axis similar to a forward pass in the game of football. The launching device includes a spring-biased, retractable catapult arm with a ball-holding basket on the end thereof. The device is provided with a governor which delays the launching of the ball for a predetermined time period to allow the user to move into position for receiving the ball. The launching device includes height adjustments and spring tension adjustments for regulating the trajectory of the football. A safety interlocking mechanism is provided to prevent the launching of foreign objects. The device cannot be operated unless a football is loaded in the basket. The basket has a size, shape, orientation and edge portion which accurately simulates the trajectory of a thrown football by imparting a spiral spin to the football.

8 Claims, 6 Drawing Figures

10
18
14
42
46
84
40
56
44
24
58
66
34
48a
36
48
160
157
158
156
154
152
150
21
48b
33a
32
31
33
52
98
108
102
90
86
106
100
104
105
B
C
94
88
92
142
140

10
14
4
3
18
20
12
42
84
40
46
56
24
58
34
158
60
64
36
38
5
70
68
120
122
124
134
66
112
114
128
110
130
102
98
90
104
108
30
48
140
92
94
88
106

FOOTBALL LAUNCHING APPARATUS

BACKGROUND OF THE INVENTION

This invention relates to game ball launching devices and in particular to a device wherein a football is launched into an airborne trajectory.

In the past many ball launching devices have been provided for projecting a series of balls at regular intervals for the purpose of permitting a novice or professional player to practice the game without the necessity of having available another player to throw the ball.

A number of machines also have been constructed in the past for launching a football into a predetermined trajectory. However, most of these machines were of the centering type for practice by a quarterback in receiving the ball from the center position, as disclosed by Maxcey in U.S. Pat. No. 2,767,985, or of the type that simulates a kick-off or a punt, as disclosed by Retrum in U.S. Pat. No. 3,662,728. Heretofore, no football launching device has been provided which would simulate the trajectory of a hand thrown football, as that in a pass play, for imparting a spiral spin to the football.

SUMMARY OF THE INVENTION

The launching device, according to the present invention, includes a support housing enclosing a spring-biased pivotally mounted catapult arm with a spin imparting means in the form of a basket secured to the end thereof which imparts a spiral spin to the football as it is launched. The catapult arm is manually retracted against the force of the spring and is maintained in a cocked retracted position by a locking mechanism. The locking mechanism is operatively associated with a governor which delays the launching of the ball for a predetermined time period to allow the user the position himelf for receiving the launched ball.

The launching device also includes elevation adjustments and spring tension adjustments to vary the trajectory of the launched football.

Thus, it is the object of this invention to provide a new and improved football launching device which can launch a football into an airborne trajectory and at the same time impart a spiral spin to the football as is associated with the normal pass play in the game of football.

Other objects, features and advantages of the invention will be apparent from the following detailed description taken in connection with the accompanying drawings.

DESCRIPTION OF THE PREFERRED EMBODIMENT

Figure 1:
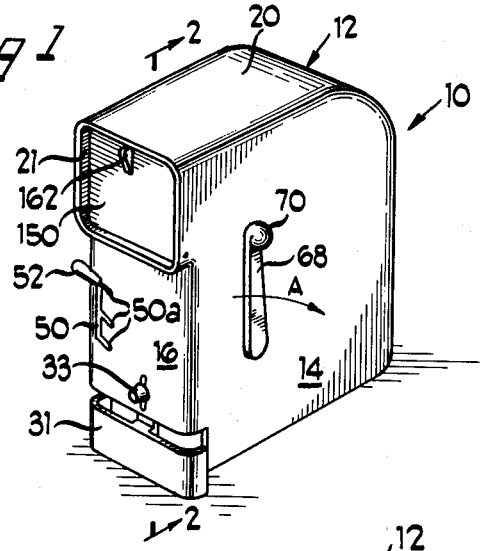
FIG. 1 is a perspective view of the football launching device of the present invention.

The launching device of the present invention, generally designated 10, includes a base structure in the form of a substantially hollow, generally rectangular housing, generally designated 12, formed of sheet metal, plastic, or the like. The housing includes two side walls 14, a front wall 16 and a rear wall 18 which curves into a top wall 20. A rectangular opening 21 is provided at the top front wall 16 of the housing for loading a football 22 (FIG. 6) therethrough and also through which the football 22 is launched. A catapult means, generally designated 24, is pivotally mounted within the housing for launching the football 22. The catapult means 24 is associated with a delaying governor, generally designated 28, which delays the launching of the football 22, after the catapult means is cocked to permit a user to move away from the device 10 for receiving the football 22. An interlocking mechanism, generally designated 30 (FIGS. 2, 3, 4, 5 and 6) is associated with the governor 28 and prevents the launching of any object which is not the same size and shape as a football for which the device is designed.

The front wall 16 of the housing includes a partially overlapping adjustable slide section 31 for varying the attitude of the launching device 10. The adjustable slide section 31 includes a boss 32 provided with internal threads. An elevation knob 33 is provided with a threaded shaft **33*a* (FIG. 3) threaded into boss 32 to clamp the adjustable slide section 31 against the front wall and lock the section 31** in any desired position. This establishes the height of the front of the device relative to its supporting surface and thus the "elevation" control for the device.

Figure 6:
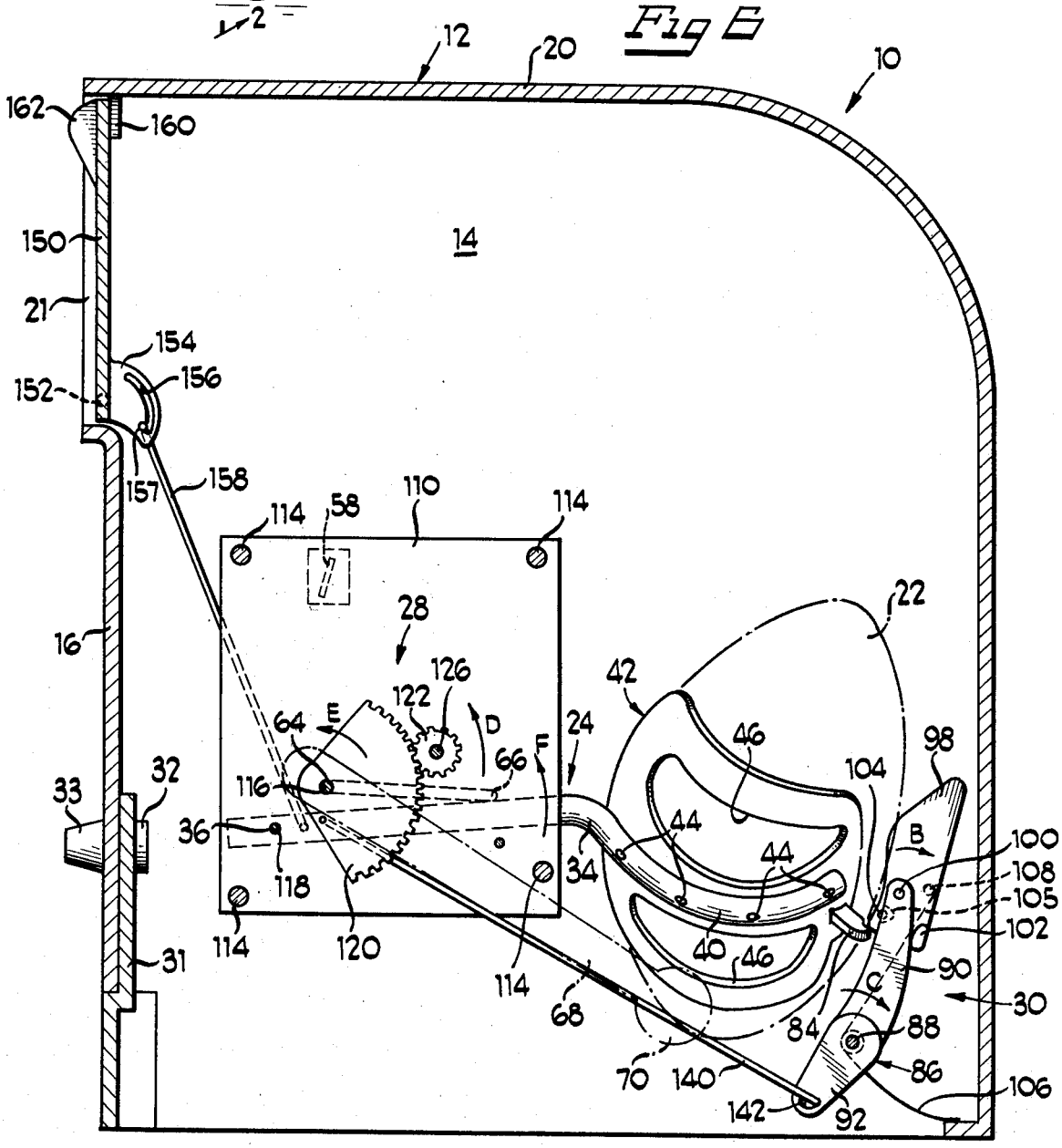
FIG. 6 is a vertical section, similar to FIG. 4, illustrating the launching device in its cocked position.
Figure 3:
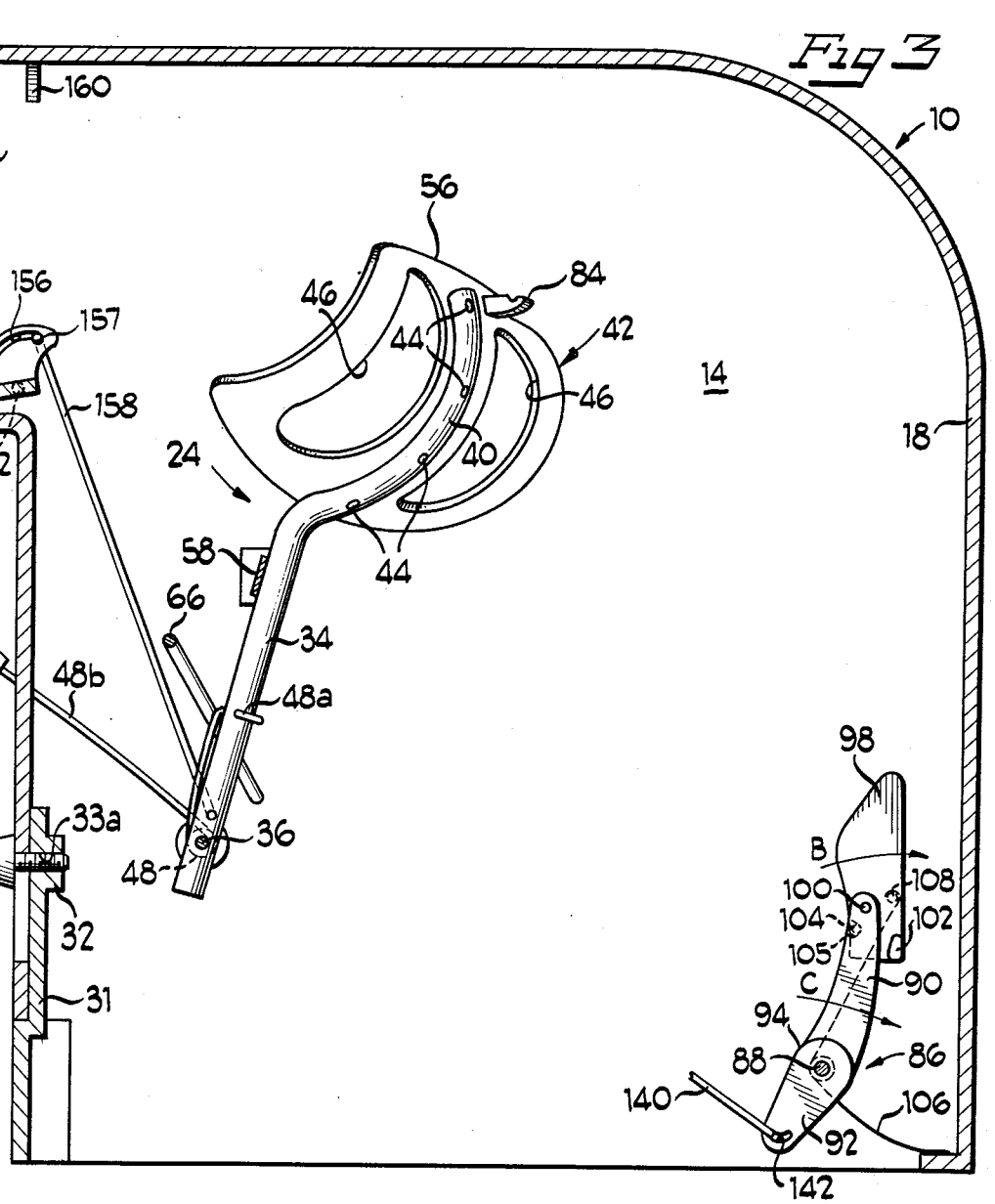
FIG. 3 is a vertical section taken generally along the line 3—3 of FIG. 2.
Figure 2:
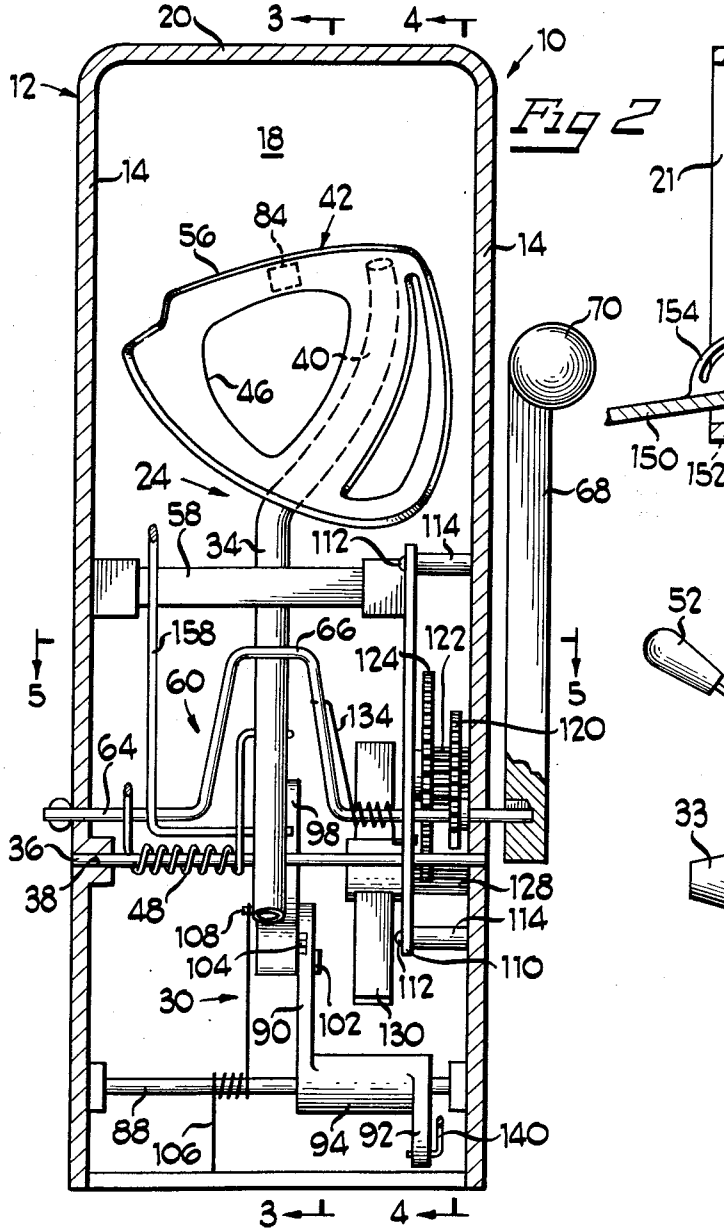
FIG. 2 is a vertical section, on an enlarged scale, taken generally along the line 2—2 of FIG. 1.
Figure 4:
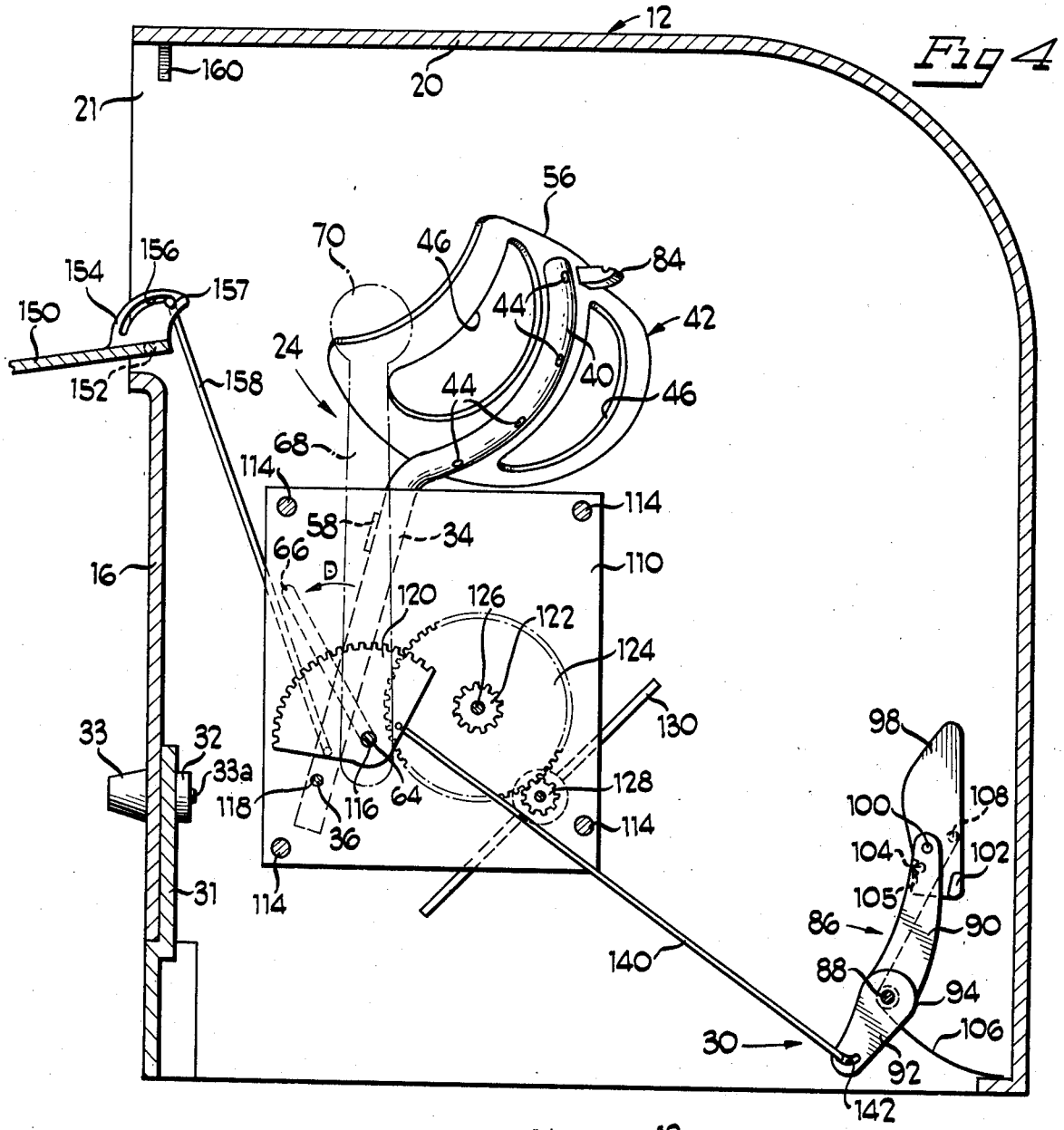
FIG. 4 is a vertical section taken generally along the line 4—4 of FIG. 2.
Figure 5:
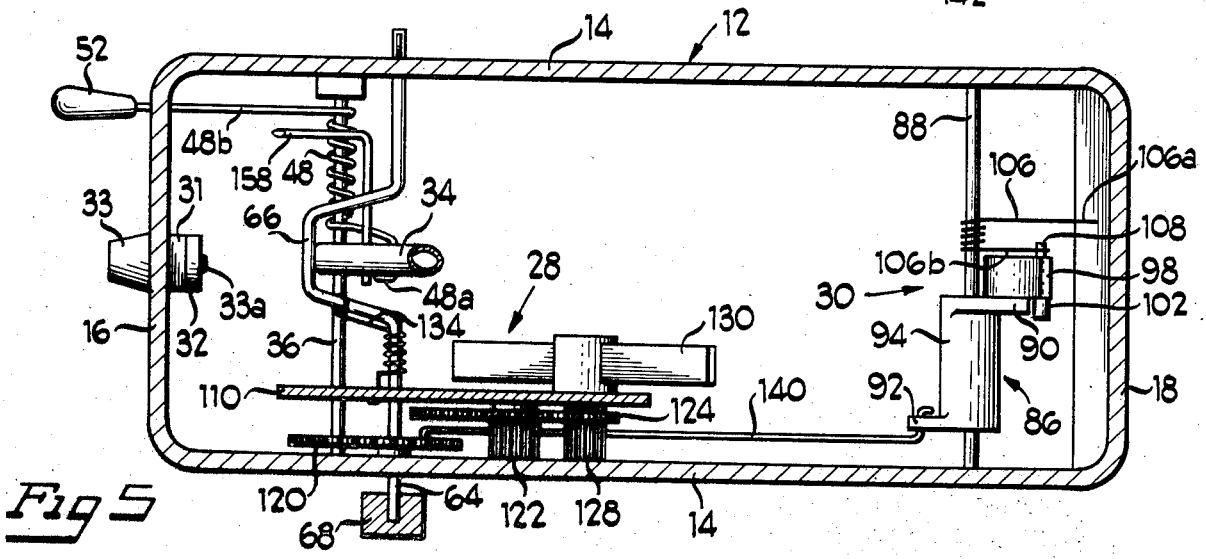
FIG. 5 is a horizontal section taken generally along the line 5—5 of FIG. 2.

Looking to FIGS. 2, 4 and 6, the catapult means 24 includes a catapult arm 34 which is pivotally mounted midway between the side walls 14 by a shaft 36 journalled in holes 38 on the side walls 14. The upper end of the catapult arm 34 includes a curved section 40 which supports a spin imparting means, generally designated 42. The spin imparting means 42 is formed in the shape of a basket and is secured to the catapult arm 34 by bolts or rivets 44. The basket 42 is generally in the shape of a section of an ellipsaid and includes two relatively large cutouts 46. Actually the basket is shaped with the contour of football, but less than half thereof in reference to a plane through the longitudinal axis of the football. The cutouts 46 serve to prevent the launching of small object such as rocks, baseballs or the like which will fall through the cutouts. A catapult spring 48 is coiled around the shaft 36 and is hooked around the catapult arm 34 at **48*a* at one end. The other end 48*b* of the spring 48 extends through the front wall 16 of the housing through an adjustment slot 50 which allows the end of the spring 48 to be set in a plurality of positions, defined by notches 50*a* (FIG 1) in slot 50, which will vary the amount of tension applied to the arm 34. A handle 52 is secured to the end of spring 48 to enable manual adjustment of the spring tension. Thus, generally, a ball 22 will be launched as the catapult arm rotates from a cocked position (shown in FIG.5 and described hereinafter) to a launched position, as shown in FIGS. 2, 3 and 4**.

The basket 42 is secured to the catapult arm 34 at approximately a 45° angle relative to the plane of rotation of the catapult arm and, in addition, is canted so that its open side faces generally forwardly when in the launching position shown in FIG. 2. An upper rear edge 56 of the basket 42, extending at an angle to said plane, is the principal engaging portion of the basket on the football 22 as the arm rotates under the force of the spring 48. The football simultaneously is moving out of the basket 42 under centrifugal force as the edge 56 continuously pushes on the football. Thus, this trailing edge 56 is the only substantial engaging area between the ball 22 and the basket 42 as the catapult arm 34 rotates toward its launched position. The effect of the trailing edge 56 contacting the ball 22 as it rotates from its cocked to its launched position is to impart a spiral turn to the football 22 about its longitudinal axis as it leaves the basket 42 with the ball pointed generally in a forward direction. A band 58 secured to the housing 12 abruptly stops the rotation of the catapult arm at the launched position as the catapult arm 34 approaches a vertical orientation as the football is launched through the opening 21 into a trajectory with a spiral motion.

A cocking mechanism, generally designated 60 (FIG. 2), is provided in order to rotate the catapult arm 34 to its cocked position (FIG. 6). More particularly, referring to FIGS. 2, 4 and 6, the cocking mechanism 60 includes a crankshaft 64 which is pivotally mounted in the housing side walls 14. The crankshaft 64 includes an offset lever portion 66 approximately midway between the side walls 14 such that the lever portion 66 will contact the catapult arm 34 eccentric of the crankshaft 64. A crank 68 is secured to the right end of the crankshaft 64 as seen in FIG. 2. A spherical handle 70 is provided on the end of the crank for ease in hand rotation of the crank. The crank 68 is rotated in the direction of arrow A (FIG. 1) to cock the catapult arm 34 as the lever portion 66 of the crankshaft 64 contacts the catapult arm 34 and rotates the catapult arm 34 in the same direction against the force of the spring 48.

The interlocking mechanism 30 (FIGS. 3, 4 and 6) is used to hold the catapult arm 34 in its cocked position until the governor 28 releases it. More particularly, the interlocking mechanism 30 includes a notched ear 84 secured to the basket 42. The interlocking mechanism 30 also includes release lever, generally designated 86, which is pivotally supported on a shaft 88 mounted between the side walls 14. The release lever 86 comprises an upwardly directed portion 90 and a downwardly directed portion 92 (FIG. 5) both of which are secured to a bearing section 94 mounted on the shaft 88. A ball contact member 98 is pivotally secured to the upper end of member 90 by means of a pin 100. The ball contact element 98 includes a tab 102 (FIG. 5) which contacts the back of member 90 and a pin 104 which contacts a notched portion 105 of member 90. This contact of the pins 102 and 104 against the upper element 90, limit the arc of rotation of the ball contact element 98. A coil spring 106 (FIG. 5) is secured at one end **106*a* to the housing 12 and is secured at the other end106*b* to a pin 108 on the contact element 98 and biases the ball contact element 98 in a counterclockwise direction as seen in FIG. 6. As the crank arm 68 is rotated in the direction of arrow A to cock the launching mechanism, the football 22 contacts the ball contact element 98 and rotates that element in a clockwise direction as shown by arrow B (FIGS. 3 and 6). The stop tab 102 then will contact the back of the upper element 90, which prevents rotation of the contact element 98 relative to the member 90, and then causes the release lever 86 to rotate in a clockwise direction as shown by arrow C (FIGS. 3 and 6). With continued rotation of the catapult arm 34, the contact element 98 will engage in the ear 84 and hold the catapult arm 34** in its cocked position.

The governor 28 operates to delay the time period in which the catapult arm is released. The governor 28 actually provides time delay means which includes a vertical mounting plate 110 secured to the right wall 14 of the housing by means of screws 112. The vertical plate 110 is spaced from and inside of the right wall 14 by sleeves 114. The plate 110 includes clearance holes 116 and 118 for the crankshaft 64 and the catapult arm support shaft 36. The governor 28 generally includes three gears which are mounted on the plate 110. A release gear 120 (FIGS. 4 and 6) formed in the shape of approximately a 90° segment of a circular gear is secured to the crankshaft 64. When the launching device is in its cocked position, the release gear 120 is in meshing engagement with a pinion gear 122. The pinion gear 122 is secured to a larger gear 124 which is mounted on a shaft 126 between the vertical plate 110 and the right wall 14, as seen in FIG. 2. The larger gear 124 is in meshing engagement with another pinion gear 128 which is rotatably mounted between the vertical plate 110 and the wall 14. The pinion gear is secured to a spoked air friction governor means 130. Of course, other types of flywheel governors are contemplated. After the catapult arm is cocked, a spring 134 (FIG. 2) which is coiled around the crankshaft 64 and secured to the lever portion 66 causes the crankshaft to rotate in a counterclockwise direction (arrow D) as seen in FIGS. 6 and 4. This rotation causes conjoint rotation of the release gear 120. The flywheel 130 which is connected through gears 124 and 122 to the release gear 120, impedes and slows the rotation of the crankshaft 64. This impeding mechanism allows the user of the device to move away from the launching device into position to receive a launched ball 22. A connecting rod 140 connects the release gear 120 with the interlocking mechanism 30. The connecting rod 140 is pivotally connected to the release gear 120 and engages the release lever 86 by an arcuate slot 142. The arcuate slot 142 provides lost motion and allows the release gear 120 to rotate counterclockwise in the direction of arrow E (FIG. 6) from its position as shown in FIG. 6 to its position as shown in FIG. 4 without releasing the interlocking mechanism. At an instant before the release gear 120 reaches its position as shown in FIG. 4, the connecting rod 140 causes the release lever 86 to rotate in a clockwise direction (FIG. 6, arrow C) and causes the contact element 98 to slip off the ear 84 and release the catapult arm. The catapult arm 34 then rotates in the direction of arrow F (FIG. 6) under the force of spring 48 until it contacts the stop band 58. When the catapult arm 34 contacts the stop band 58, the ball 22 is launched through the opening 21. It should be noted that at the time the catapult arm 34 is released by the interlocking mechanism 30, the crankshaft 64 and the lever portion 66 are in a position as shown in FIG. 4 and thus the lever portion 66 does not contact the catapult arm 34. Thus, the governor 28 slowly rotates the crankshaft 64 out of an interference path with the catapult arm 34 and then finally releases the catapult arm for launching of the ball 22. The amount of time which the governor delays the release is predetermined by the characteristics of the spring 134 and the size of the flywheel 130.

The launching device 10 also is provided with a door 150 which closes the opening 21 when the device is in its cocked position as shown in FIG. 6. The door 150 is pivotally mounted within the opening 21 by means of a pin 152 mounted in the side walls 14. The door 150 includes a tab 154 which is provided with an arcuate slot 156 and an offset notch 157 at the back lowermost end of the slot 156. A connecting rod 158 engages at one end in the arcuate slot 156 normally at notch 157 and is pivotally secured to the catapult arm 34 on its other end. The door 150 normally is in an open position when the device 10 is in its launched position (FIG. 3) so that a football 22 may be loaded into the basket 42. As the crank arm 68 is rotated in the direction of arrow A (FIG. 1) the connecting rod 158 will engage the bottom of the slot 156 adjacent the notch 157 and cause the door 150 to close. Two stop tabs 160, one on either side of the opening 21, position the door 150 in a vertical closed position as shown in FIG. 6. As the catapult arm 34 rotates back in the direction of arrow D (FIG. 6) to launch the football 22, the door 150 will be moved open by engagement of the rod 158 in the notch 157 to allow the football 22 to be launched through the opening 21. The slot 156 is provided to permit closing of the door 150 during storage or shipment of the launching device 10 when the catapult arm is in its launched position (FIG. 4). To close the door 150, the connecting rod 158 must be moved out of engagement with the notch 157 to allow the end of the connecting rod 158 to move toward the front uppermost end of the slot 156. A tab or handle 162 is provided on the front of the door 150 to facilitate opening of the door for loading of a football 22 after the door 150 has been closed for storage, etc. When the door is opened, the rod snaps back into notch 157 for operational purposes.

At this time, it is appropriate that the features of the interlocking mechanism and the governor be pointed out. As previously described, an object which is smaller than a football, such as a baseball or large rock, will not be supported in the basket 42 because the openings 46 allow it to fall through the basket. In addition, any object which is not the size and shape of football, will not contact the ball contact element 98 and properly cause the interlocking mechanism to hold the catapult arm 34 in its cocked position. In this event, the catapult arm 34 will immediately start to rotate upwardly in the direction of arrow F (FIG. 6) but its speed of rotation will be slowed by the action of the crank lever portion 66 in contact with the catapult arm 34 and the force of the flywheel 130, such that any object of this nature will not be launched, because of the slow speed of rotation of the catapult arm 34. It should also be pointed out that any large heavy object which is the size and shape of a football, and causes the interlocking mechanism to hold the catapult arm 34 in its cocked position, will not be launched because of the inability of the spring 48 to rotate the catapult arm 34 upwardly.

The spring tension of the spring 48 on the catapult arm 34 is a critical feature of the invention 10. The amount of tension applied to the catapult arm 34 by the spring 48 must be proportional to the size and shape of the football 22 so that the football 22 will roll out of the basket 42 under centrifugal force and yet not roll completely off the trailing edge 56 before the catapult arm reaches its launched position. With proper design of the spring element 48 of the device 10, the invention can be made to launch any size football such as a small toy football or a regulation size football.

The foregoing detailed description has been given for clearness of understanding only and no unnecessary limitations should be understood therefrom, as some alterations will be obvious to those skilled in the art.

I claim as my invention:

1. In a ball throwing device, which includes a base structure, a launching mechanism movably mounted on the base structure for movement between a retracted cocked position and a launching position with receiving means for the ball, and drive means for operating said launching mechanism for moving the launching mechanism from said cocked position to said launching position to throw the ball, the improvement comprising: means to hold said launching mechanism in said cocked position and a safety interlocking mechanism operatively associated with said holding means for sensing the presence of a ball in said receiving means and immobilizing said holding means to prevent said launching mechanism from being held in its cocked position when a ball is not positioned in said receiving means.

2. The device of claim 1 wherein said receiving means is comprised of an open framework having cross braces to support said football but with relatively large openings between said cross braces through which foreign objects smaller than the size of an object which will actuate the safety interlocking mechanism will fall to prevent said foreign objects from being launched by said launching mechanism.

3. The improvement of claim 1 including governor means operatively associated with said launching mechanism to slow the movement thereof from said cocked position to said launching position for only a given period of time after said launching mechanism is moved to its cocked position so that if said safety interlocking mechanism prevents the launching mechanism from being retained in its cocked position said governor means slows the movement of said launching mechanism toward its launching position.

4. A throwing device for a football having a generally ellipsoidal shape with an enlarged mid-portion converging toward opposite ends defining its longitudinal axis, comprising: a base structure, a catapult arm pivotally mounted on said base structure, drive means for rapidly pivoting said catapult arm relative to said base structure for launching purposes, and a ball holder mounted on the free swinging end of said catapult arm for receiving the football to cradle the same when the launching mechanism is at a starting rest position, the ball holder being in the form of an avoid surface segment of an ellipsoid for engaging said football when received therein for imparting a spin to the football generally about its longitudinal axis through said opposite ends thereof when launched by said mechanism, said ball holder being oriented so that the longitudinal axis of the ellipsoidal shape of which it is an avoid surface segment is disposed at an angle of approximately 45° with respect to the plane of travel of the catapult arm as well as being canted so that its open side faces generally forwardly when the catapult arm and ball holder are in their launching position whereby a trailing edge portion along the outermost periphery of the ball holder frictionally engages the football as the football moves out of the ball holder under centrifugal force during pivoting of the catapult arm to cause the football to roll off of said trailing edge during launching whereby the football is launched in a spiral motion spinning about its longitudinal axis which intersects the vertical plane of travel at an angle of approximately 45°.

5. The device of claim 4 wherein said launching mechanism is driven between a retracted cocked position and a launching position and including time delay means to hold the launching mechanism in said cocked position a predetermined amount of time before the launching mechanism is driven toward said launching position to give user an opportunity to move away from the device to catch the object launched thereby.

6. The device of claim 4 wherein said launching mechanism is driven between a retracted cocked position and a launching position and including an opening in said base structure through which the ball is launched and a closable door within said opening operatively associated with the launching mechanism for movement thereby so as to close said opening when said launching mechanism is in its retracted cocked position and open said door as said launching mechanism is driven toward said launching position.

7. A football throwing device, comprising: a base structure, a launching mechanism movably mounted on said base structure and having means for receiving a football and launching the same through the air in response to movement of said launching mechanism, drive means for operating said launching mechanism, said receiving means having means engageable with said football when received therein for launching the football in response to movement of the launching mechanism, and a safety interlocking mechanism operatively associated with said drive means to prevent operating said launching mechanism when a football is not received in said receiving means.

8. The device of claim 7 wherein said launching mechanism is movable between a retracted cocked position and a launching position and wherein said safety interlocking mechanism is operatively associated with said launching mechanism to prevent the launching mechanism from being retained in its cocked position when a football-like object is not positioned in said receiving means.

* * * * *

UNITED STATES PATENT OFFICE

CERTIFICATE OF CORRECTION

Patent No. 3,977,386 Dated August 31st, 1976

Inventor(s) BURTON C. MEYER

It is certified that error appears in the above-identified patent and that said Letters Patent are hereby corrected as shown below:

Column 6, line 50, change "avoid" to --ovoid--;

line 56, change "avoid" to --ovoid--.

Signed and Sealed this

Seventh Day of December 1976

[SEAL]

*Attest:*

RUTH C. MASON
*Attesting Officer*

C. MARSHALL DANN
*Commissioner of Patents and Trademarks*